United States Patent [19]

Hilfiker et al.

[11] Patent Number: 4,816,798

[45] Date of Patent: Mar. 28, 1989

[54] ELECTRICAL PROTECTION SWITCH

[75] Inventors: Peter Hilfiker, Buchs; Willy Feller, Rombach; Hans Luethy, Holziken, all of Switzerland

[73] Assignee: Sprecher and Schuh AG, Switzerland

[21] Appl. No.: 32,600

[22] Filed: Apr. 1, 1987

[30] Foreign Application Priority Data

Apr. 7, 1986 [CH] Switzerland ..... 01351/86

[51] Int. Cl.[4] ..... H01H 73/48; H01H 75/12

[52] U.S. Cl. ..... 335/175; 335/23

[58] Field of Search ..... 335/175, 174, 23, 21, 335/170

[56] References Cited

U.S. PATENT DOCUMENTS

| | | | |
|---|---|---|---|
| 2,060,481 | 11/1936 | Austin | 337/175 |
| 2,875,294 | 2/1959 | Schleicher | 337/175 |
| 3,189,707 | 6/1965 | Norden et al. | 335/36 |
| 3,659,235 | 4/1972 | Scheibel et al. | 335/35 |
| 4,135,134 | 1/1979 | Ebel et al. | 335/20 |
| 4,514,709 | 4/1985 | Nakano | 337/23 |
| 4,608,546 | 8/1986 | Westermeyer | 337/175 |
| 4,641,001 | 2/1987 | Fujihisa | 337/175 |

FOREIGN PATENT DOCUMENTS

| | | |
|---|---|---|
| 2616554 | 10/1977 | Fed. Rep. of Germany . |
| 2527831 | 12/1983 | France . |
| 479950 | 11/1969 | Sweden . |
| 2127225A | 4/1984 | United Kingdom . |

*Primary Examiner*—H. Broome

*Attorney, Agent, or Firm*—Hill, Van Santen, Steadman & Simpson

[57] ABSTRACT

An electrical protection switch, or circuit breaker, includes a movable contact part rotatably seated on a bolt which is secured to a leg of a mount. The other leg of the mount lies against a flange of a coil member which forms a portion of a magnetic release means. Two retaining elements extending parallel to one another and mutually spaced apart project from this flange. The retaining elements accept one leg of the mount therebetween and are provided with resilient tongues which press against the leg of the mount lying against the flange and, thus, press the leg against the flange. Fastening of the mount having the movable contact part to the magnetic release means, or coil member, is performed simply by slipping the mount onto the coil member by a snap-in connection.

18 Claims, 1 Drawing Sheet

ELECTRICAL PROTECTION SWITCH

BACKGROUND OF THE INVENTION

1. Field of the Invention

The present invention relates generally to an electrical protection switch for a circuit breaker having a magnetic release for actuating a movable contact part.

2. Description of the Related Art

In a known protection switch as disclosed in Swiss Patent No. 479,950, a movable contact part is seated on a bolt which is secured to a bow which is secured to a reflux part of a magnetic release means. The magnetic release means includes a release coil having a winding, one end of which is welded to the bow. Despite its simplicity, the disclosed protection switch is nonetheless relatively involved in terms of its manufacture and assembly.

In a protection switch as disclosed in Great British Patent No. GB 2 127 225, a retaining part is secured to a yoke of a magnetic release means. The switch drive is also attached to the retaining part next to a movable contact part. The design includes many individual component parts which occupy a comparatively great space and require a considerable outlay during assembly.

SUMMARY OF THE INVENTION

An object of the present invention is to provide a protection switch having a magnetic release mans and a movable contact part which form a compact unit occupying as little space as possible, and which can be assembled in a simple way and can be integrated in a switch housing together with other component parts. The electrical protection switch of the present invention is of a simple and reliably functioning design.

This and other objects of the invention are achieved in an electrical protection switch or a circuit breaker having a mount for a movable contact part which is held at a magnetic release means by a snap-in connection. Thanks to the snap-in connection, the attachment between the mount carrying the movable contact part and the magnetic release means is accomplished in a simple way by plugging the mount, together with the movable contact part, into the magnetic release means.

A circuit breaker which is especially simple and compact in structure results when the connection between the mount and the magnetic release means includes at least one retaining member having an elastically deflectable latch member to hold the mount and release means together. In a preferred embodiment, a pair of retaining elements are provided spaced apart and connected to a coil member of the release coil, the retaining elements accepting the mount therebetween. Means are also provided in a preferred embodiment for preventing the transverse dislocation of the mount relative to the retaining elements.

The mount is preferably connected to one end of the winding of the release coil and the movable contact part is seated on a bearing bolt attached to the mount.

A fast opening switch contact for short circuits is achieved by the magnetic release means including an armature in the form of a tie rod that acts on the movable contact part. An especially compact structure of the present inventive protection switch is achieved when a coupling member is provided on the bearing bolt, the coupling member cooperating with the movable contact part for opening by an actuation element and having an interactive connection with the movable contact part through a contact pressure spring in the closing direction. The contact pressure spring is a torsion spring pressing the coupling element against the movable contact part.

DESCRIPTION OF THE PREFERRED EMBODIMENTS

Figure 1:
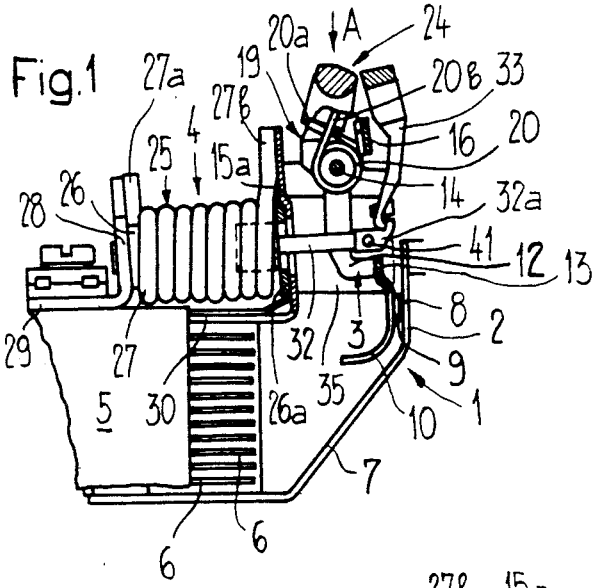
FIG. 1 is a side elevational view, partially in cross section, showing a portion of an electrical protection switch including a magnetic release means, according to the principles of the present invention.

In FIG. 1, a portion of a three-phase protection switch is shown, the illustrated portion corresponding to one phase of the three-phase switch. Each of the three phases have the same structure as the illustrated portion.

The one-phase switch portion 1 is formed by a stationary contact part 2 and a movable contact part 3. The switch contact portion 1 has a magnetic release means 4, as well as a quenching chamber 5 having a quenching plate 6. The stationary contact part 2 is formed in one piece with an arc fin 7 extending toward the quenching chamber 5. The stationary contact carries a contact element 8 which cooperates with a contact element 9 mounted on the movable contact part 3.

Figure 5:
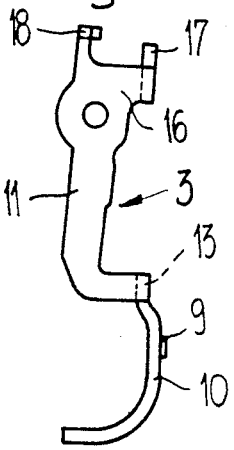
FIG. 5 is a side elevational view of the movable contact part of FIG. 1.

With reference to both FIGS. 1 and 5, the movable contact part 3 has the contact element 9 secured to a contact carrier 10 which is connected to two spaced apart and parallel extending connecting parts 11 and 12. The connecting parts 11 and 12 are in communication with one another by a web 13 extending therebetween. Only the connecting part 12 is shown in FIG. 1, while the connecting part 12 is hidden behind the connecting part 11 in the view of FIG. 5. The two connecting parts 11 and 12 are rotatably seated on a bolt 14 which is secured to a mount 15 formed of electrically conductive material, such as copper. At their respective top ends, the two connecting parts 11 and 12 are connected to one another by a U-shaped bow 16. The U-shaped bow 16, which can be seen more clearly in FIGS. 2 and 5, includes an upwardly extending continuation, or tab, 17 and a somewhat hook-shaped stop 18.

Figure 2:
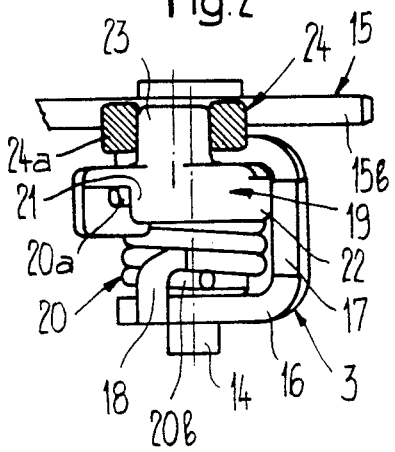
FIG. 2 is an enlarged plan view in the direction of arrow A of FIG. 1 showing a coupling member torsion spring and bearing portion of the movable contact part.

In FIGS. 1 and 2, a coupling member is rotatably seated on the bolt 14. A torsion spring 20 is also seated on the bolt 14 having a first end **20*a* supported against a shoulder 21 of the coupling member 19 and a second end 20*b* supported against the stop 18 of the movable contact part 3. The coupling member 19 also includes a stop portion 22 which abuts against the continuation 17 of the movable contact part 3 and is biased thereagainst by the torsion spring 20. A salient cam 23**, shown in FIG. 2, engages into an end 24*a* of an actuation element 24, the end 24*a* being fork-shaped. The actuation element 24 forms a portion of the switch drive which is shared by all phase portions of the present protection switch and is not shown in greater detail herein.

The magnetic release means 4 includes a release coil 25 having a coil member 26 of plastic, which carries a coil winding 27. The coil winding 27 has a first end 27*a* welded to an L-shaped terminal part 28 that includes a connecting terminal 29. A second opposite end 27*b* of the winding 27 is welded to a leg 15*a* of the mount 15. The leg 15*a* is formed in one piece with an arc fin 30 and extends along the release coil 25. A plate 31 of ferromagnetic material is secured to the arc fin 30 at the side facing the winding 27 to promote the commutation of arcs on the arc fin 30, which appear when the switch contact 1 is opened.

An armature 32 is provided inside the coil member 26 and is longitudinally displaceable within the coil in response to current flow through the coil. The armature 32 extends between the parallel connecting parts 11 and 12 of the movable contact part 3 and has a first end 32*a* for operative engagement against the connecting parts 11 and 12 during the longitudinal displacement. The armature 32, and more specifically, the armature end 32*a*, also cooperatively engages a release element 33 which forms a portion of the switch release mechanism. The actuation element 24 and release element 33 are linked to similar elements (not shown) for simultaneous operation of all phase portions of the multi-phase switch.

Figure 3:
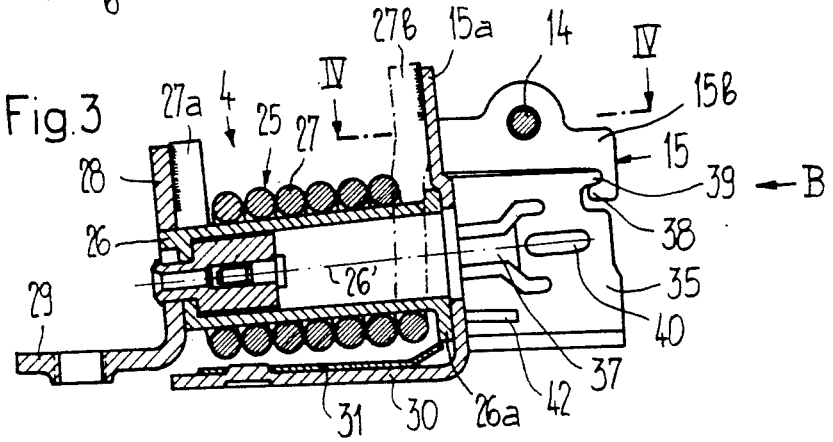
FIG. 3 is an enlarged longitudinal cross section through the magnetic, release means of FIG. 1.
Figure 4:
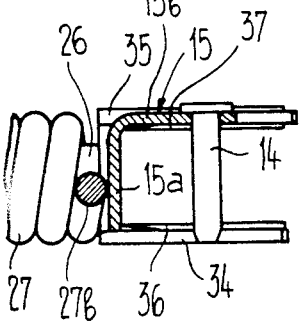
FIG. 4 is a cross section along the line IV—IV of FIG. 3 showing the bearing bolt and mount mounted in the retaining elements.

Two retaining elements 34 and 35 project generally axially from the coil member 26 and are formed in one piece therewith and, more particularly, are connected with a flange 26*a* of the coil member 26. The retaining members 34 and 35 are spaced apart and are approximately parallel to one another, as can be seen in FIG. 4. Each of the retaining elements 34 and 35 is provided with a resilient tongue 36 and 37, respectively, the tongue 37 on the retaining element 35 being shown more clearly in FIG. 3. The two tongues 36 and 37, shown in FIG. 4, are bent somewhat toward one another at their free ends, i.e. they are biased inwardly.

The mount 15 includes a leg 15*a* which is clamped fast by the elastically resilient tongues 36 and. 37 against the flange 26*a* of the coil member 26. With reference to FIG. 3, another leg 15*b*, which is angled off relative to the leg 15*a* of the mount 15 is seated on an edge of the retaining element 35. The leg 15*b* of the mount 15 has a hook-like continuation 38 engaging a salient tab 39 formed on the retaining element 35.

The two elastically bendable tongues 36 and 37 hold the mount 15 against the coil member 26 by forming a snap-in connection. Dislocation of the mount 15 transversely of the acting direction of the tongues 36 and 37 is prevented, first, by the seating of the mount leg 15*b* on the retaining element 35 and, second, by the continuation 38 engaging the salient tab 39. Movement in the bias direction of the tongues 36 and 37 is also prevented, since the leg 15*a* is between the two retaining elements 34 and 35. Thus, dislocation of the mount 15 transversely relative to a longitudinal axis 26′ of the coil 26 is prevented.

Still referring to FIG. 3, longitudinal slots 40 extending in the direction of the longitudinal axis 26′ of the coil member 26 are present in the two retaining elements 34 and 35. The armature 32 shown in FIG. 1 includes laterally projecting continuations 41 extending from either side into the longitudinal slots 40 to guide movement of the armature 32 along the longitudinal slots 40, and thus along the longitudinal axis 26′.

One phase of the present electrical protection switch, or circuit breaker, is shown in FIG. 1 with the contact switch 1 closed. To open the switch contact 1, the actuation element 24 is pivoted in a counter-clockwise direction which turns the coupling member 19 in a clockwise direction. Since the coupling member 19 has the stop portion 22 resting against the continuation 17 of the movable contact part 3, the movable contact part 3 is immediately caused to pivot away from the stationary contact part 2 as the coupling member 19 is pivoted. The two contact elements 8 and 9 are, thus, quickly separated from one another. Any arcs formed when the switching contact 1 is opened immediately migrate onto the arc fins 7 and 30.

To close the switch contact 1, the actuation element 24 is pivoted in a clockwise direction. This results in rotation of the coupling member 19 in a counterclockwise direction. The torsion spring 20 transmits the rotation of the coupling member 19 to the movable contact part 3. The torsion spring 20 acts as a contact pressure spring to press the movable contact part 3 against the stationary contact part 2 when the switch contact 1 is in the closed position and thereby ensure a positive contact between the two contact elements 8 and 9.

Upon the occurrence of a short circuit or other fault condition, the magnetic release means 4 responds, which causes the armature 32 to retract along the longitudinal axis 26′. Since the end 32*a* of the armature 32 engages the connecting parts 11 and 12 of the movable contact 3, the backward movement of the armature 32 moves the movable contact part 3 away from the stationary contact part 2 so that the switch contact 1 is opened. Simultaneously, the release element 33 is entrained, whereby the switch release mechanism is actuated, such as to open other phase portions of the multiphase switch. As a consequence of the direct action of the armature 32 on the movable contact part 3, the switch contact 1 is quickly opened. Any arcs formed during opening of the switch contact 1 commutate to the arc fins 7 and 30, as already mentioned. This quick opening avoids the problem of current flowing for a short period of time through the stationary and movable contact parts 2 and 3 after a short circuit has occurred. The short circuit current is, thus, prevented from flowing through the bolt 14 for any length of time, so that the bolt 14 is not overstressed and failure thereof is avoided.

Assembly of the magnetic release means 4 and the mount 15 for the movable contact part 3 is undertaken simply by plugging the mount 15 into the magnetic release means 4 in the direction of the longitudinal axis 26′ of the coil member 26. During the course of this plugging, the resilient tongues 36 and 37 are bent somewhat back and then snapped into their idle positions so that they press the leg 15*a* of the mount 15 against the flange 26*a* of the coil member 26 and, thus, fix the mount 15 in place. Simultaneously, the continuation 38 on the leg 15*b* of the mount 15 interacts with the salient tab 29 of the retaining element 35 to prevent transverse dislocation.

The structural unit formed of the magnetic release means 4, the mount 15, the bolt 14, the movable contact part 3, the coupling member 19, and the torsion spring 20 has a very compact and space-saving structure and can not only be assembled very simply, but also can be quickly and unproblematically integrated into the switch housing into which corresponding structural elements for the other phases, as well as additional component parts, such as, for example, the bimetallic actuators and common switch drive parts, are accommodated.

Although described in conjunction with a multiphase protection switch, the structure according to the present invention can also be provided in a single phase protection switch.

It is self-evident that the described protection switch can be fashioned differently than described and shown in terms of its various parts. Of the various possible modifications, a few are described hereinafter.

Figure 6:
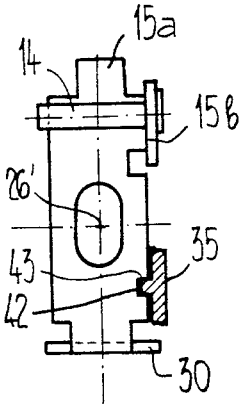
FIG. 6 is an end elevational view in the direction of arrow B of FIG. 3 showing the mount of the present electrical protection switch.

As shown in FIG. 3, and in particular, in FIG. 6, a salient rib 42 is provided either on the retaining element 35 or the retaining element 34 (not shown), or on both the retaining elements 34 and 35 (also not shown). The salient rib 42 extends in the direction of the longitudinal axis 26' of the coil member 26. The rib 42 engages into a recess 43 laterally provided on the leg 15*a* of the mount 15. Correspondingly, a second recess (not shown) can be provided at the opposite side edge of the leg 15*a* for engaging a rib on the retaining element 34. As a result of the rib 42 engaged in the recess 43, displacement of the mount 15 in a transverse direction relative to the acting direction of the tongues 36 and 37 is prevented. This is in addition to the effect achieved by the continuation 38 and the salient tab 39.

The same effect could also be achieved in an alternate embodiment if a salient tab (not shown) were provided on the leg 15*a*, the salient tab engaging into a guide groove on the retaining element.

The snap-in connection between the mount 15 and the magnetic release means 4 is also subject to different designs from that shown. For example, it is conceivable to form the resilient tongues (not shown) on the legs 15*a* of the mount 15 instead of providing them at the retaining elements 34 and 35. In this case, projections against which the tongues on the leg 15*a* press are provided on the retaining elements 34 and 35 to prevent dislocation of the mount 15.

It is also conceivable to provide only one retaining element 35 and to hold the mount 15 at some other location in a suitable way, for example, by means of a continuation on the leg 15*a* which engages under an interlock element on the flange 26*a* of the coil member 26. Each of the above-described variations still enables the mount 15 and coil member 26 to be assembled quickly and simply as previously described.

Although other modifications and changes may be suggested by those skilled in the art, it is the intention of the inventors to embody within the patent warranted hereon all changes and modifications as reasonably and properly come within the scope of their contribution to the art.

We claim as our invention:

1. An electrical protection switch comprising:

at least one contact formed by a stationary and a movable contact part;

a magnetic release means allocated to said movable contact part;

a mount for said movable contact part to be applied to said magnetic release means;

snap-in connection means for holding said mount with respect to said magnetic release means; and at least one retaining element on said magnetic release means having an elastically deflectable latch member acting on said mount.

2. An electrical protection switch as claimed in claim 1, further comprising:

said mount having an elastically deflectable latch member acting on a retaining element on said magnetic release means.

3. An electrical protection switch as claimed in claim 1, wherein said magnetic release means includes a release coil having a coil member, and further comprising:

retaining elements connected to said coil member and disposed at a distance from one another, said retaining elements accepting said mount therebetween.

4. An electrical protection switch as claimed in claim 3, wherein every one of said retaining elements is provided with a tongue-like latch member, said coil member includes a stop part, and said mount is retained between said latch members and said stop part.

5. An electrical protection switch as claimed in claim 4, wherein said stop part is a flange.

6. An electrical protection switch as claimed in claim 4, wherein said mount is supported against said retaining elements and, further comprising:

means for securing said mount against dislocation transversely relative to an acting direction of said latch members.

7. An electrical protection switch as claimed in claim 1, further comprising:

a release coil having a winding, one end of said winding being connected to said mount, and a bearing bolt carried by said mount, said movable contact being seated on said bearing bolt.

8. An electrical protection switch as claimed in claim 7, wherein said mount includes an arc guiding element.

9. An electrical protection switch as claimed in claim 8, further comprising:

a coating of ferromagnetic material on said arc guiding element.

10. An electrical protection switch as claimed in claim 1, wherein said magnetic release means includes an armature in the form of a tie rod operable to act on said movable contact part.

11. An electrical protection switch as claimed in claim 10, wherein said magnetic release means includes a release coil having a coil member, and further comprising:

retaining elements connected to said coil member and disposed at a distance from one another, said retaining elements accepting said mount therebetween, said retaining elements including guides for guiding said armature.

12. An electrical protection switch as claimed in claim 11, wherein said guides are guide slots.

13. An electrical protection switch as claimed in claim 10, further comprising:

a release element for releasing said switch, said release element being actuatable by said armature upon response of said magnetic release means.

14. An electrical protection switch as claimed in claim 7, further comprising:

a coupling member arranged on said bearing bolt and directly cooperating with said movable contact part in an opening sense;

an actuation element in communication with said coupling member and forming a portion of a drive for said switch; and a contact pressure spring providing an interactive connection between said movable contact part and said coupling member.

15. An electrical protection switch as claimed in claim 14, wherein said contact pressure spring is a torsion spring having a first end supported at said coupling member and a second end supported at said movable contact part, said torsion spring pressing said coupling member against said movable contact part.

16. An electrical protection switch as claimed in claim 6, further comprising:

a salient element provided at least at one retaining element; and a cooperating element interacting with said salient element and provided at said mount to prevent movement of said mount transversely relative to an acting direction of said latch members.

17. An electrical protection switch as claimed in claim 6, further comprising:

a salient element provided at said mount; and a cooperating element interacting with said salient element and provided at said retaining element to prevent movement of said mount transversely of an acting direction of said latch members.

18. An electrical protection switch as claimed in claim 16, wherein said cooperating element is a groove.

* * * * *